US005569041A

United States Patent [19]

Sonobe et al.

[11] Patent Number: 5,569,041

[45] Date of Patent: Oct. 29, 1996

[54] LOW INSERTION FORCE ELECTRICAL CONNECTOR

[75] Inventors: Toshimitsu Sonobe, Tokyo; Masahiro Yamamoto, Asahi-ku, both of Japan

[73] Assignee: Thomas & Betts Corporation, Memphis, Tenn.

[21] Appl. No.: 136,800

[22] Filed: Oct. 14, 1993

[30] Foreign Application Priority Data

Oct. 14, 1992 [JP] Japan ..... 4-276207

[51] Int. Cl.[6] ..... H01R 13/62

[52] U.S. Cl. ..... 439/157; 439/372

[58] Field of Search ..... 439/152, 153, 439/157, 159, 372

[56] References Cited

U.S. PATENT DOCUMENTS

| | | | |
|---|---|---|---|
| 625,639 | 5/1899 | Burchell . | |
| 1,302,730 | 5/1919 | Tomlinson et al. . | |
| 3,945,703 | 3/1976 | McCormick . | |
| 4,718,858 | 1/1988 | Godfrey et al. . | |
| 5,104,330 | 4/1992 | Yagi et al. . | |
| 5,145,356 | 9/1992 | Minnis . | |
| 5,174,785 | 12/1992 | Endo et al. | 439/372 |
| 5,230,635 | 7/1993 | Takenouchi et al. . | |
| 5,238,417 | 8/1993 | Hatagishi . | |

FOREIGN PATENT DOCUMENTS

| | | | |
|---|---|---|---|
| 568018 | 3/1993 | European Pat. Off. . | |
| 2240450 | 1/1983 | Germany | 439/372 |
| 658628 | 10/1951 | United Kingdom . | |
| 952651 | 9/1961 | United Kingdom . | |
| 952652 | 3/1964 | United Kingdom . | |
| 2085671 | 4/1982 | United Kingdom . | |

*Primary Examiner*—Daniel W. Howell
*Attorney, Agent, or Firm*—Robert M. Rodrick

[57] ABSTRACT

A connector is provided that can be coupled with a low inserting force and that will not terminate coupling operation while it is in an incomplete coupling state. The connector comprises a pair of housings coupled to each other, a pivotal piece pivotally provide on one of the two housings, a spring interposed between one housing and the pivotal piece, and a latch means for locking the two housings that are coupled to each other. When the two housings are coupled, and after the two housings reach a predetermined intermediate coupling state, the pivotal piece is pivoted by the spring, thereby completing coupling of the two housings.

18 Claims, 23 Drawing Sheets

LOW INSERTION FORCE ELECTRICAL CONNECTOR

FIELD OF THE INVENTION

The present invention relates to an electrical connector and, more particularly, to a connector having low insertion force.

BACKGROUND OF THE INVENTION

Conventionally, in order to prevent a connector from being semi-fitted, i.e., a method of facilitating the coupling operation itself of the connector by, e.g., decreasing an inserting force required for inserting one connector in the other connector or by providing a mechanism for multiplying a force to be applied to the connector during insertion, a method of visually checking a semi-fitted state, and a method of electrically detecting the conductive states of the contacts are known.

However, when the inserting force for the connector is decreased, the coupled connectors tend to be easily disconnected. The method of multiplying the force to be applied during insertion or detecting the conductive states of the contacts complicates the entire structure or requires a special device or measuring tool.

SUMMARY OF THE INVENTION

The present invention has been developed to address the above conventional drawbacks, and provides a connector comprising first and second housings that are coupled to each other, a pivotal piece pivotally provided on one of the two housings, a spring interposed between one housing and the pivotal piece, and a latch means for locking the two coupled housings.

In the connector according to the present invention, when the two housings are coupled, after the two housings reach a predetermined intermediate coupling state, the pivotal piece is pivoted by the operation of the spring, thereby completing coupling of the two housings.

DETAILED DESCRIPTION OF THE PREFERRED EMBODIMENTS

Figure 1:
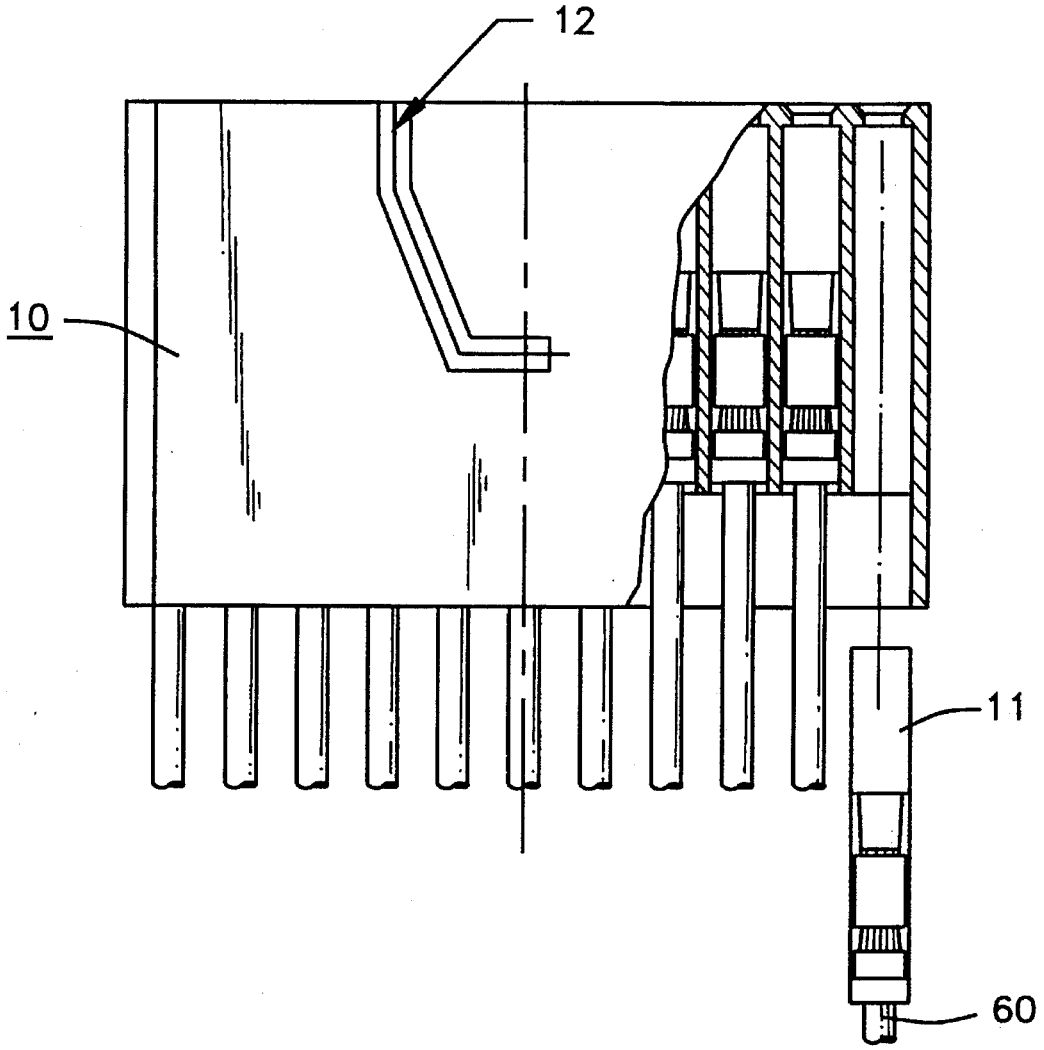
FIG. 1 is a partially cutaway plan view showing a female connector according to a first embodiment of the present invention.
Figure 2:
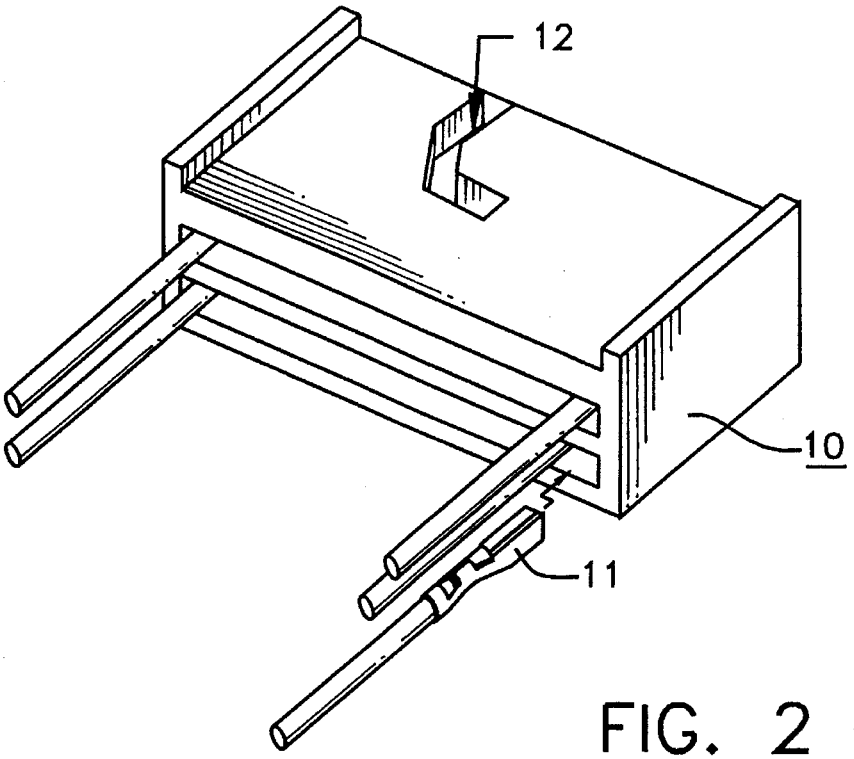
FIG. 2 is a perspective view of the female connector of FIG. 1.
Figure 3:
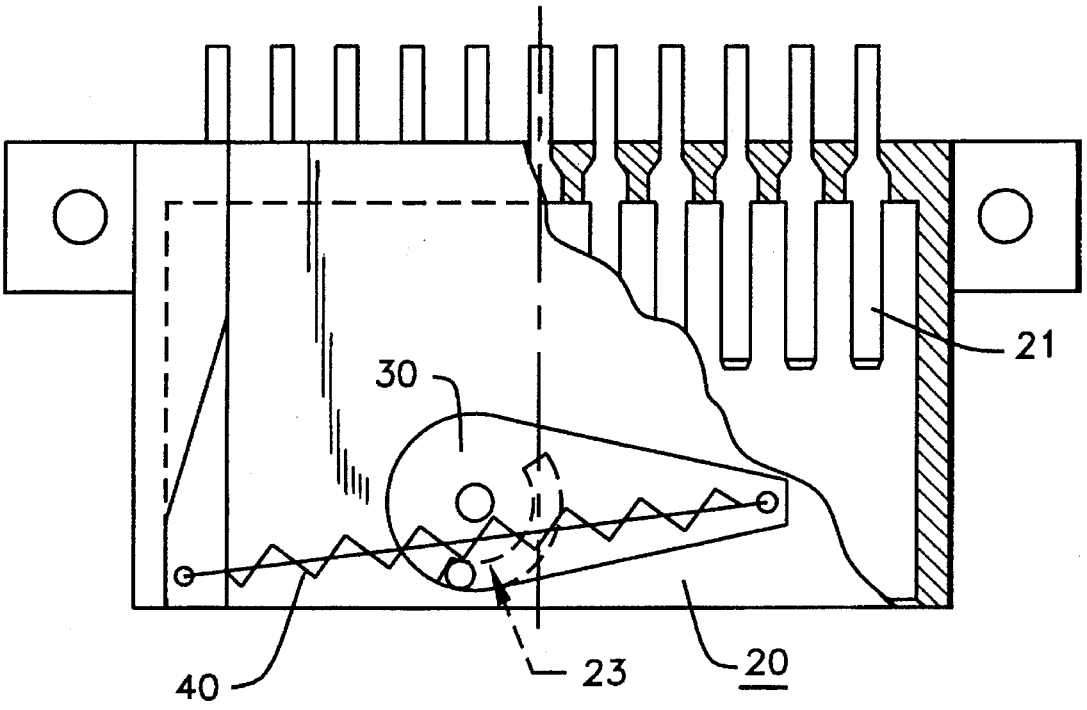
FIG. 3 is a partially cutaway plan view of a male connector according to a first embodiment of the invention.
Figure 4:
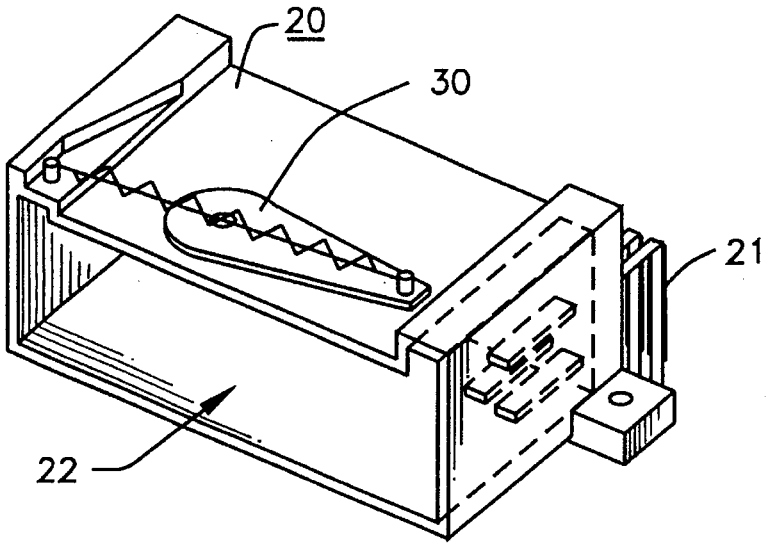
FIG. 4 is a perspective view of the male connector of FIG. 3.
Figure 8:
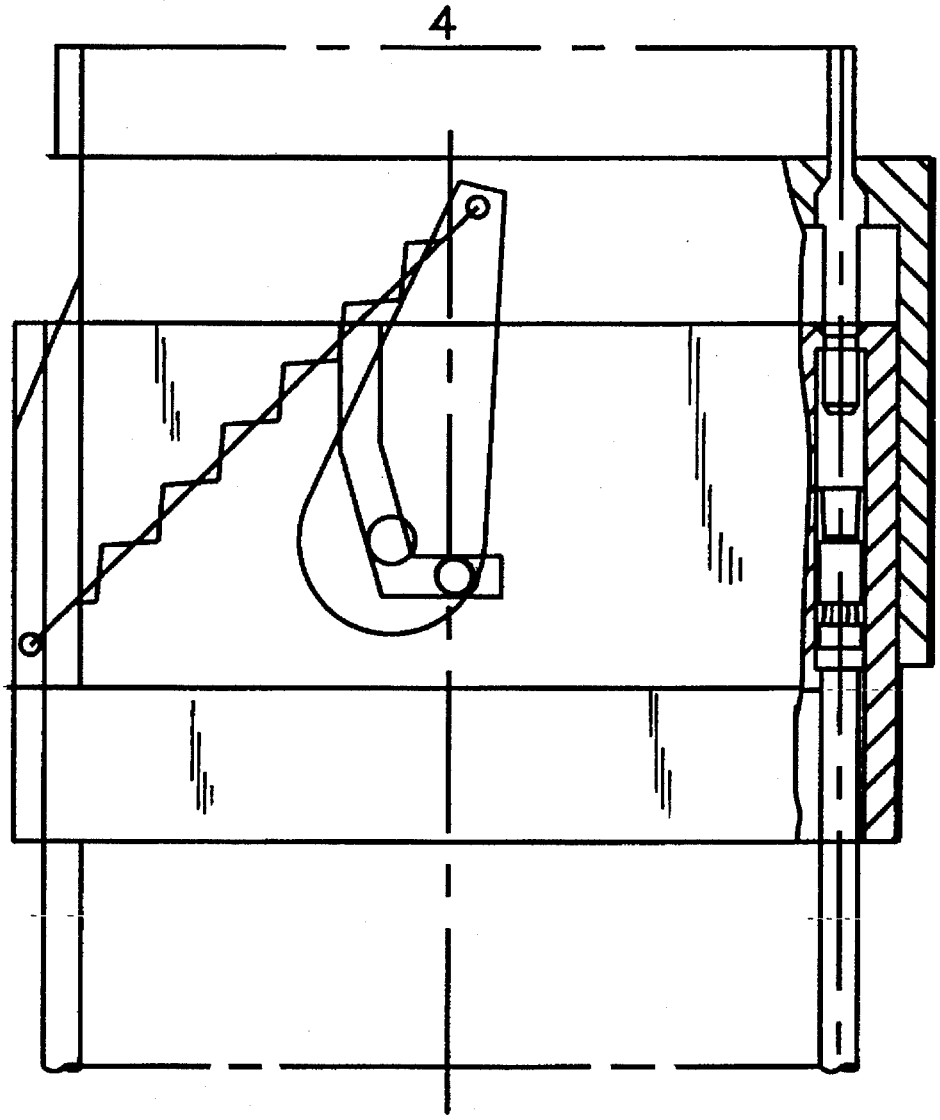
Figure 9:
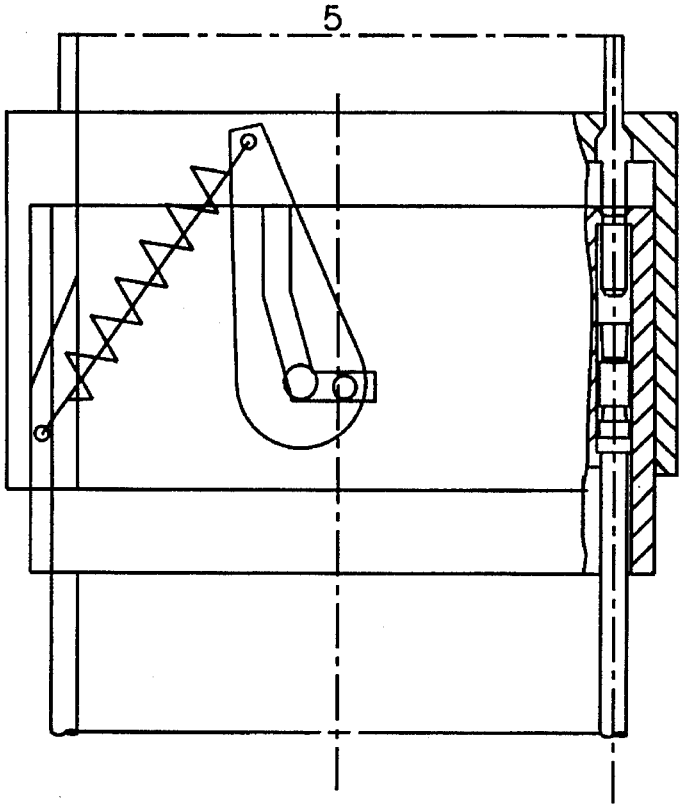
Figure 10:
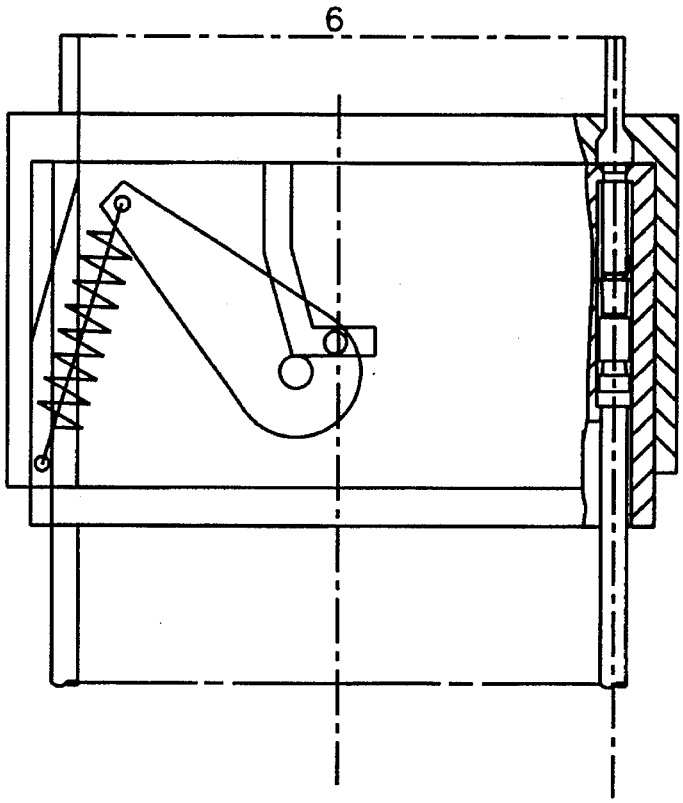

FIGS. 1 to 10 show the first embodiment of the present invention. FIGS. 1 and 2 show a harness-side connector, and FIGS. 3 and 4 show a board-side connector. FIGS. 5 through 9 show the coupling steps of the two connectors (housings), and FIG. 10 shows connectors that are completely coupled to each other.

Referring to FIG. 1, in a male housing 10, female contacts 11 terminating wire members 60 extend through its front surface and are mounted in multi-stage storing grooves formed in the housing at a predetermined pitch.

Referring to the drawings, a latch groove 12 is engaged with an engaging pin 31 of a female housing (to be described below). The latch groove 12 is described in detail hereinbelow.

Referring to FIGS. 3 and 4, in a female housing 20, a hollow portion 22 for storing the male housing is formed, and a large number of male contacts 21 extend through the rear surface of this female housing to project into the hollow portion. When the female and male housings are coupled to each other, the male contacts are connected to the female contacts of the male housing in the hollow portion. Note that the other end of each male contact is connected to the new board.

Referring to the drawings, a pivotal piece 30 is pivotally provided on the female housing. A spring 40 is interposed between the pivotal piece and the female housing.

More specifically, the pivotal piece is axially supported on the top surface of the female housing. One end of the spring is fixed to the top surface of the housing, and the other end thereof is fixed to the pivotal piece.

The engaging pin 31 stands downward from the bottom surface of the pivotal piece to project into the hollow portion through a window hole 23 formed in the upper surface (the wall surface defining the hollow portion) of the female housing.

In this embodiment, when the two housings are not coupled, since the rotating shaft of the pivotal piece is located above the spring, as is apparent from FIG. 3, the pivotal piece receives a force to pivot it clockwise. However, since the pivotal movement of the engaging pin is limited by the window hole, the pivotal piece is set still in the state shown in FIG. 3.

The female and male housings have a latch means for locking so that their connecting static is held after they are finally connected to each other. In this embodiment, the latch means comprises the engaging pin 31 provided on the pivotal piece of the female housing and the latch groove 12 formed in the male housing.

The coupling steps of the two connectors (housings) of this embodiment is described with reference to FIGS. 5 through 10.

Figure 5:
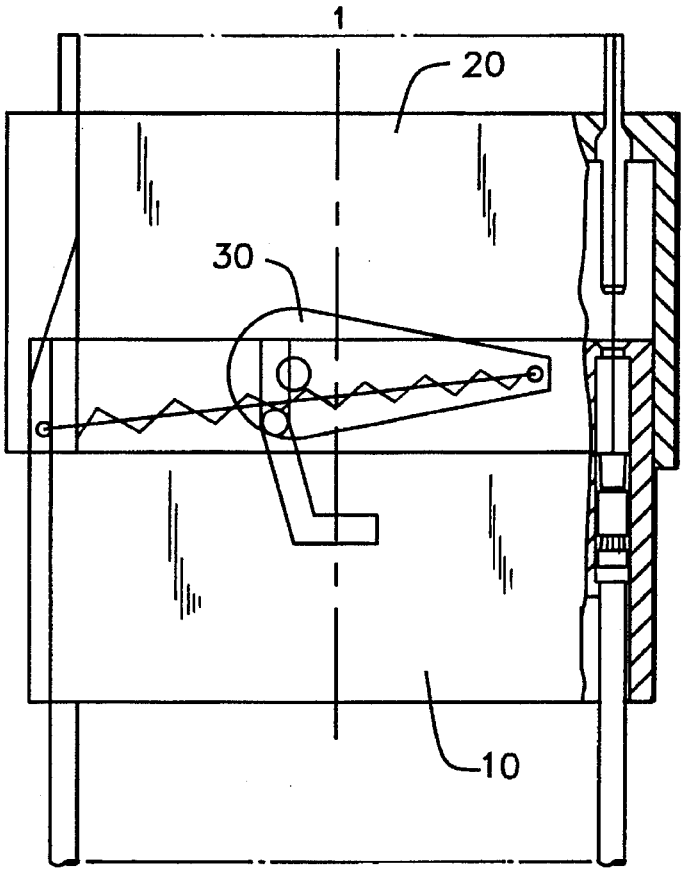
FIGS. 5–10 are partially cutaway views showing a series of coupling steps of the connectors according to the first embodiment.

FIG. 5 shows the first coupling step of the two housings. In this step, the engaging pin of the pivotal piece is merely engaged with the latch groove of the male housing, and the pivotal piece is not pivoted yet.

Figure 6:
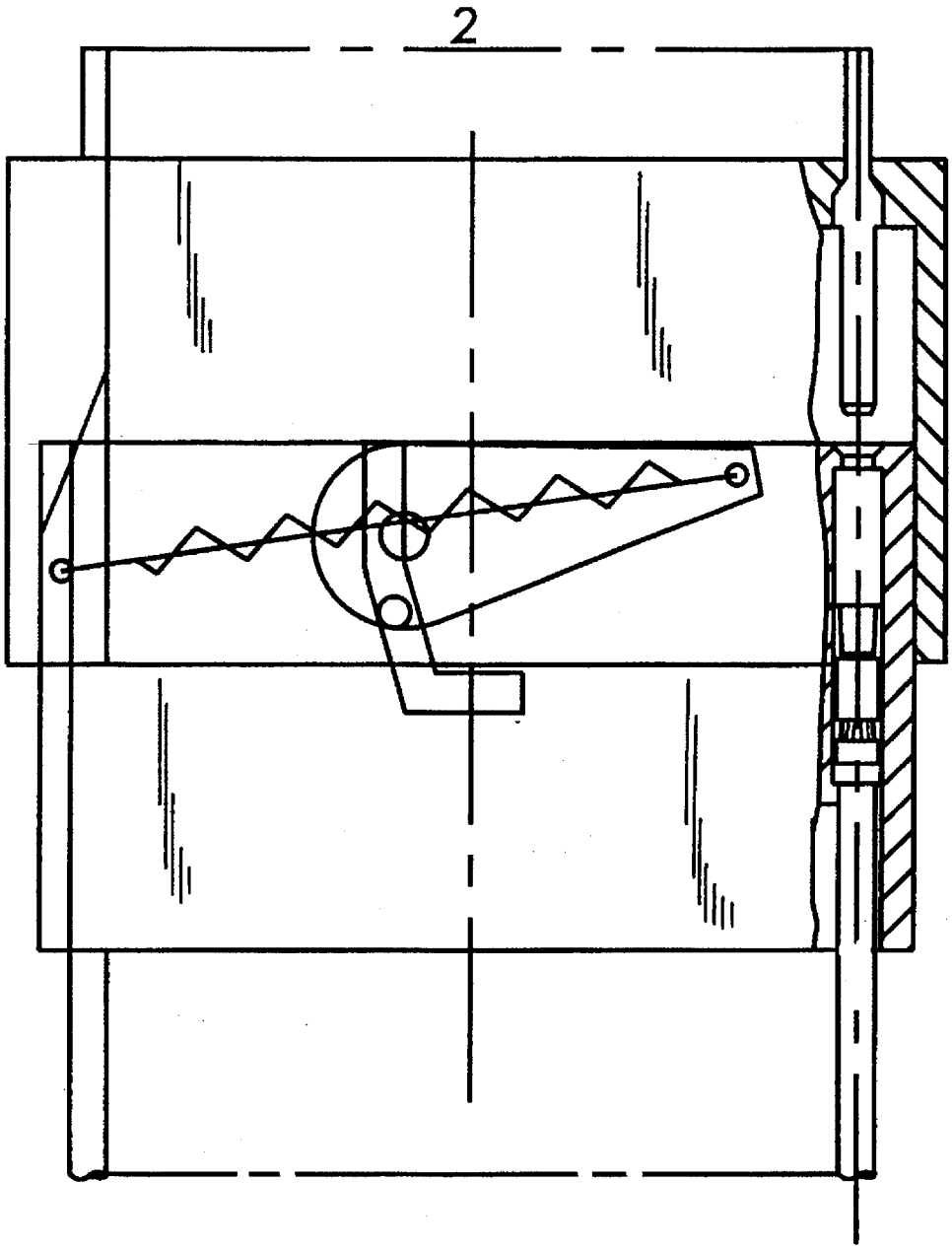

As the male housing is inserted in the female housing, the state shown in FIG. 6 is obtained. In this state, the spring and the rotating shaft of the pivotal piece are aligned on the same line. Starting from this state as a boundary, the spring contracts, and the pivotal piece receives a force from the spring to pivot counterclockwise. Accordingly, in states from the state of FIG. 7, the pivotal piece is pivoted counterclockwise without applying an external force to the housing.

Figure 7:
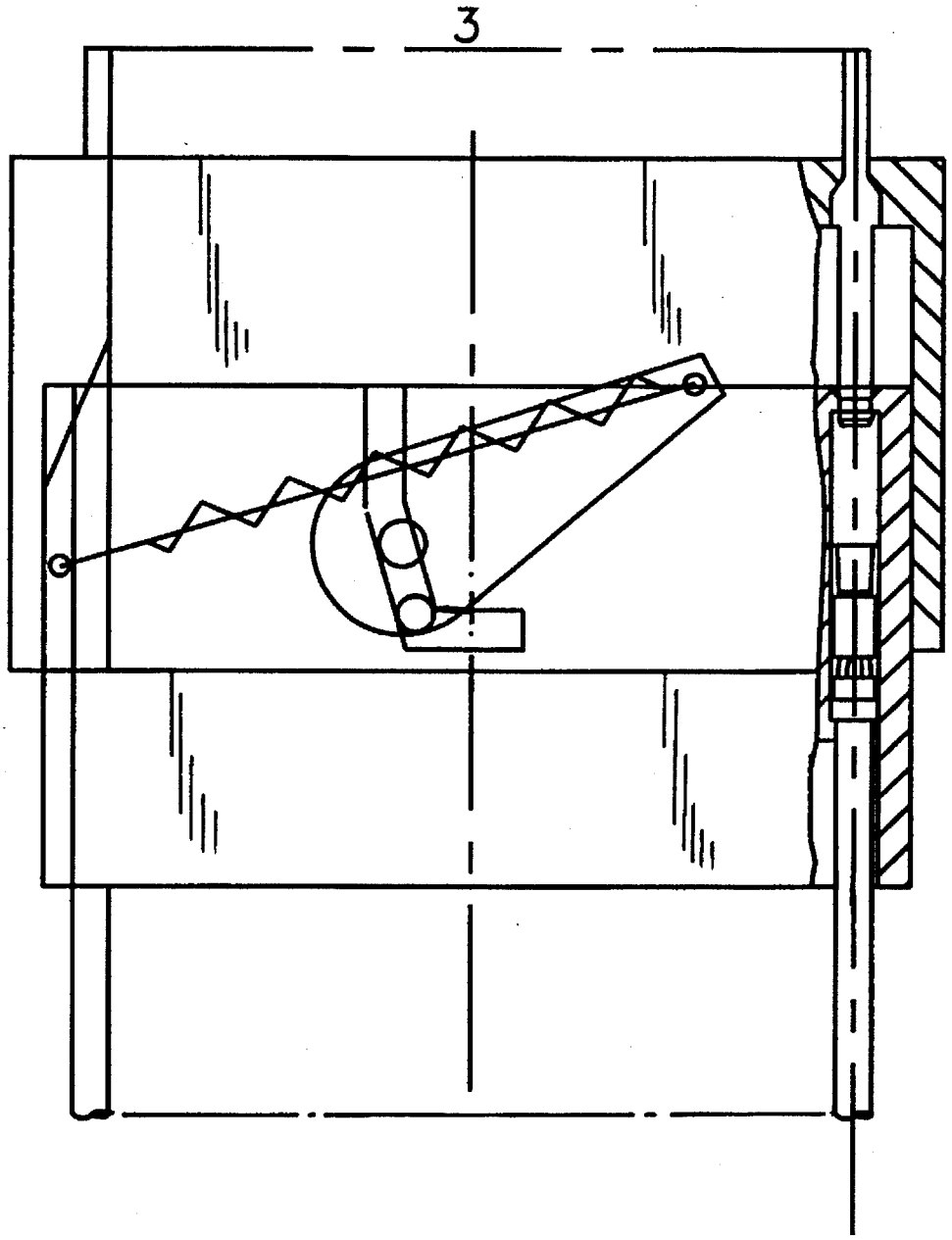

When the pivotal piece is pivoted to reach the state shown in FIG. 7, the engaging pin is engaged with the bent portion of the latch groove, thereby connecting the female and male contacts with each other and latching the two housings. This state corresponds also to a time point when the female and male contacts contact each other to start connection.

In the state of FIG. 10, connection of the female and male contacts and coupling of the two housings are completed through the states shown in FIGS. 8 and 9.

If the pivotal piece is located at a position corresponding to the coupling state (set state) of the two housings despite that the two housings are separated from each other (in the reset state) (if the pivotal piece is erroneously pivoted to the state shown in FIG. 10 despite that the two housings are in the reset state), in this embodiment, the engaging pin and the latch groove have a non-engaging positional relationship. This prohibits the two connectors from being coupled to each other when the pivotal piece is erroneously pivoted before the two connectors are coupled, so that the connector is prevented from being erroneously inserted.

Figure 11:
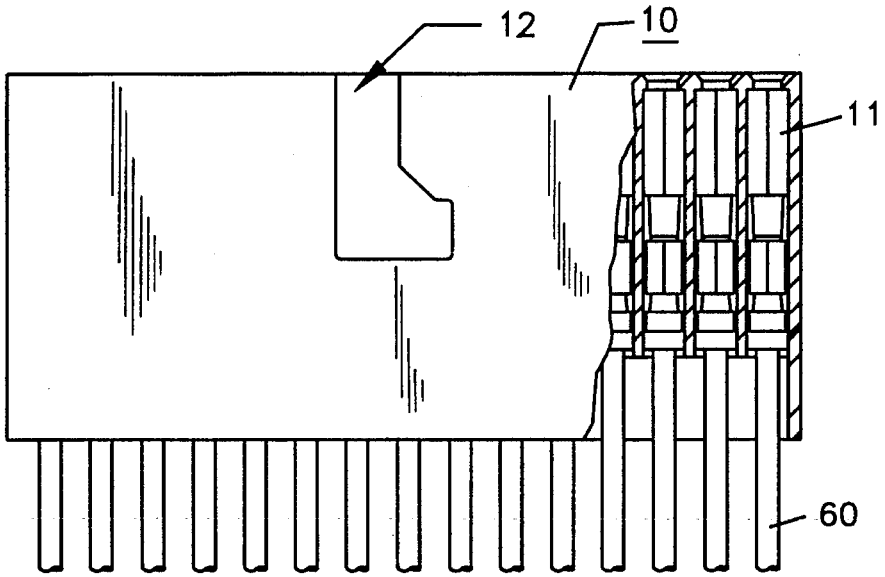
FIG. 11 is a partially cutaway plan view of a female connector according to the second embodiment of the present invention.
Figure 12:
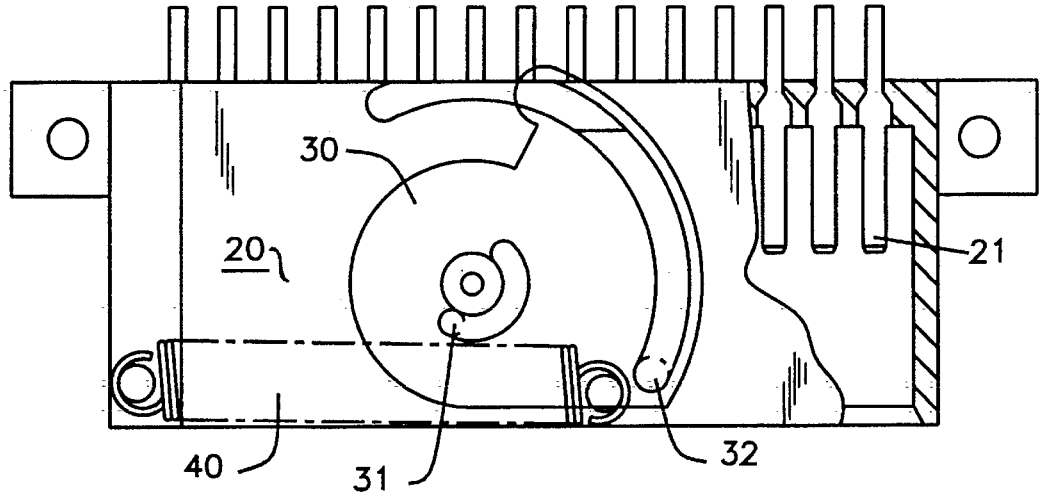
FIG. 12 is a partially cutaway plan view of a male connector according to the second embodiment.
Figure 13:
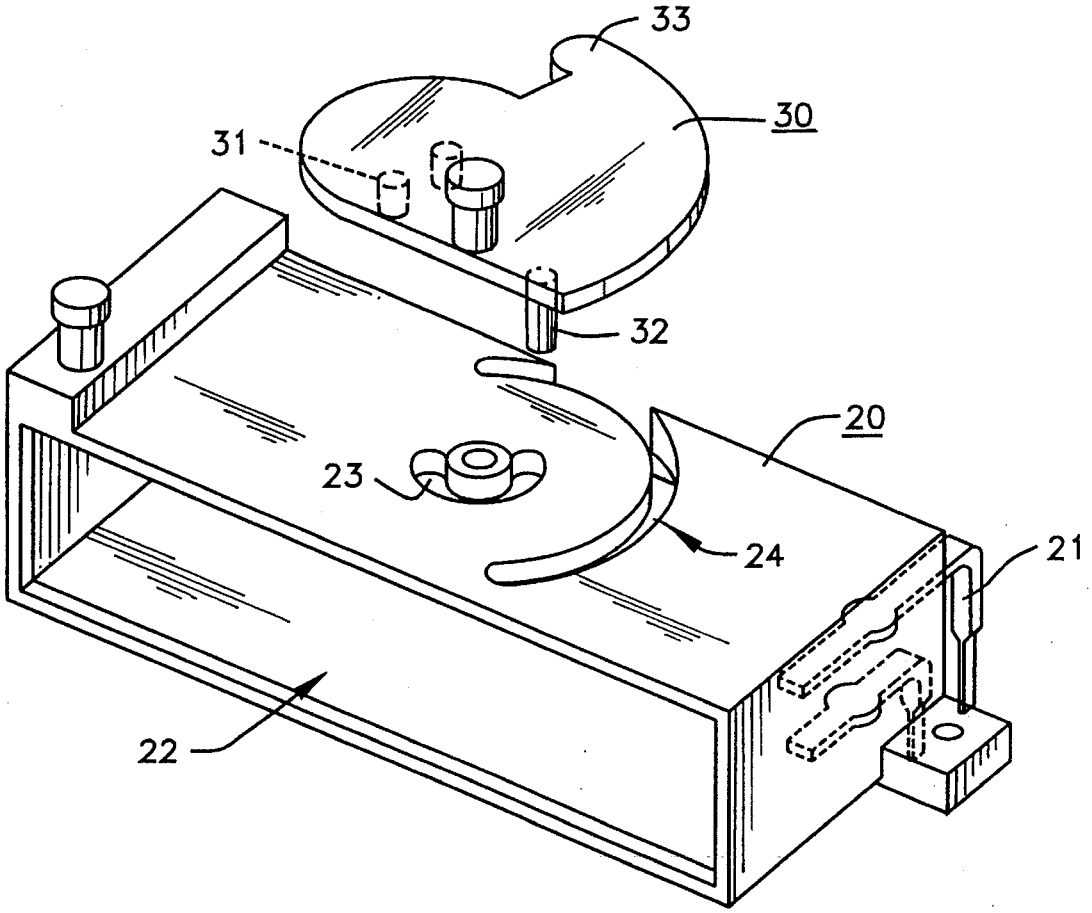
FIG. 13 is a perspective view of the male connector of FIG. 12.

FIGS. 11 through 29 show the second embodiment of the present invention. FIG. 11 shows a female connector (having female contacts), and FIGS. 12 and 13 show a male connector (having male contacts). FIGS. 14 through 21 show the coupling steps of the two connectors (housings), and FIGS. 22 and 23 show connectors that are completely coupled to each other. FIGS. 24 to 29 show steps of disconnecting the coupled connectors.

Referring to FIG. 11, in a male housing 10, female contacts 11 terminating wire members 60 extend through its front surface and are mounted in multi-stage storing grooves formed in the housing at a predetermined pitch.

Referring to the drawings, a latch groove 12 is engaged with an engaging pin 31 of a female housing (to be described below).

Referring to FIGS. 12 and 13, in a female housing 20, a hollow portion 22 for storing the male housing is formed, and a large number of male contacts 21 extend through the rear surface of this female housing to project into the hollow portion. When the female and male housings are coupled to each other, the male contacts are connected to the female contacts of the male housing in the hollow portion. Note that the other end of each male contact is connected to the board.

Referring to the drawings, a pivotal piece 30 is pivotally provided to the female housing. A spring 40 is interposed between the pivotal piece and the female housing.

More specifically, the pivotal piece is axially supported on the top surface of the female housing. One end of the spring is fixed to the top surface of the housing, and the other end thereof is fixed to the pivotal piece.

The engaging pin 31 stands downward from the bottom surface of the pivotal piece to project into the hollow portion through a window hole 23 formed in the upper surface (the wall surface defining the hollow portion) of the female housing.

The pivotal piece 30 also has a guide pin 32 projecting into the hollow portion through a guide groove 24 formed in the wall surface defining the hollow portion. When the male housing is inserted in the hollow portion, the upper portion of the front surface of the male housing pushes the guide pin projecting into the hollow portion. Then, the guide pin slides in the guide groove, thereby pivoting the pivotal piece.

In this embodiment, when the two housings are not coupled, since the rotating shaft of the pivotal piece is located above the spring, as is apparent from FIG. 12, the pivotal piece receives a force to pivot it clockwise. However, since the engaging pin is limited by the window hole and the pivotal movements of the guide pin is limited by the guide groove, the pivotal piece is set still in the state shown in FIG. 12.

The female and male housings have a latch means for locking so that their connecting state is held after they are finally connected to each other. In this embodiment, the latch means comprises the engaging pin 31 provided to the pivotal piece of the female housing and the latch groove 12 formed in the male housing.

The coupling steps of the two connectors (housings) of this embodiment are described with reference to FIGS. 14 through 21.

Figure 14:
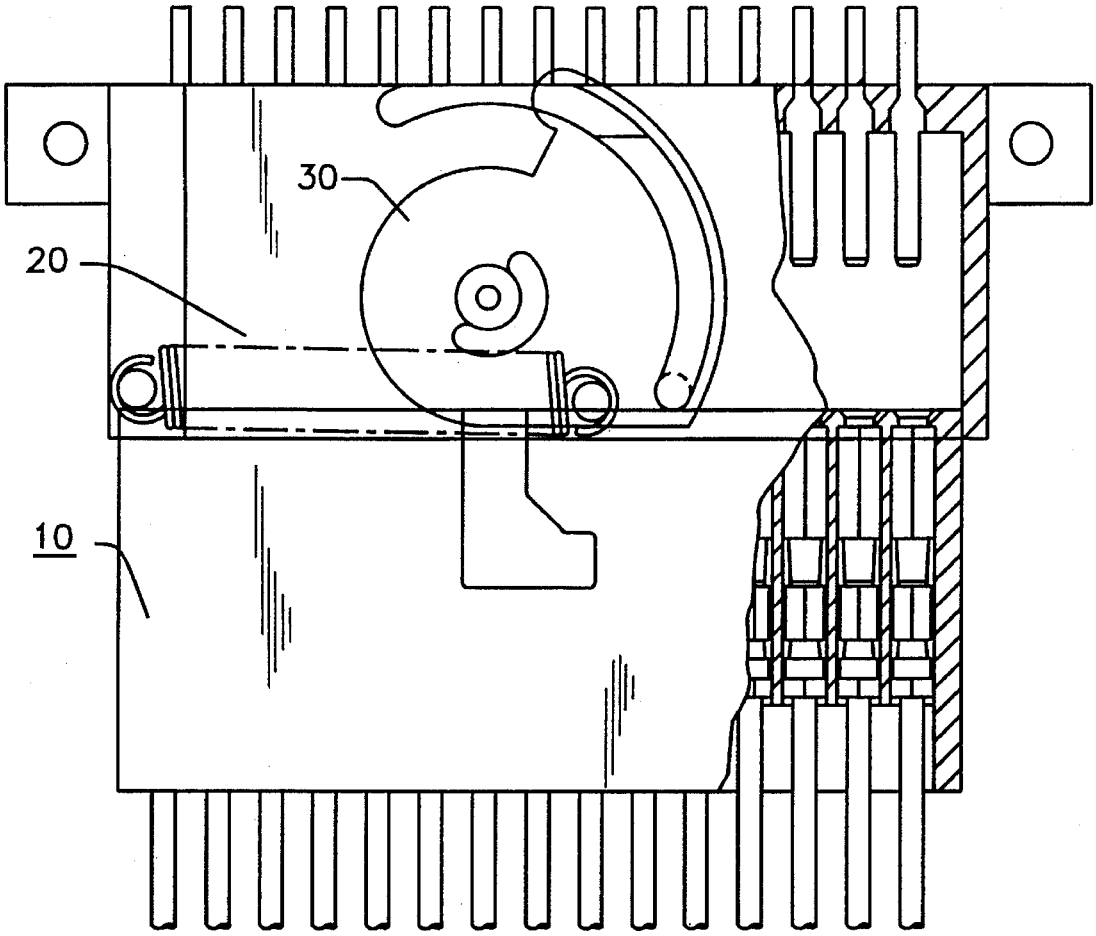
FIG. 14 is a partially cutaway view showing a coupling step of the connectors to the second embodiment.
Figure 15:
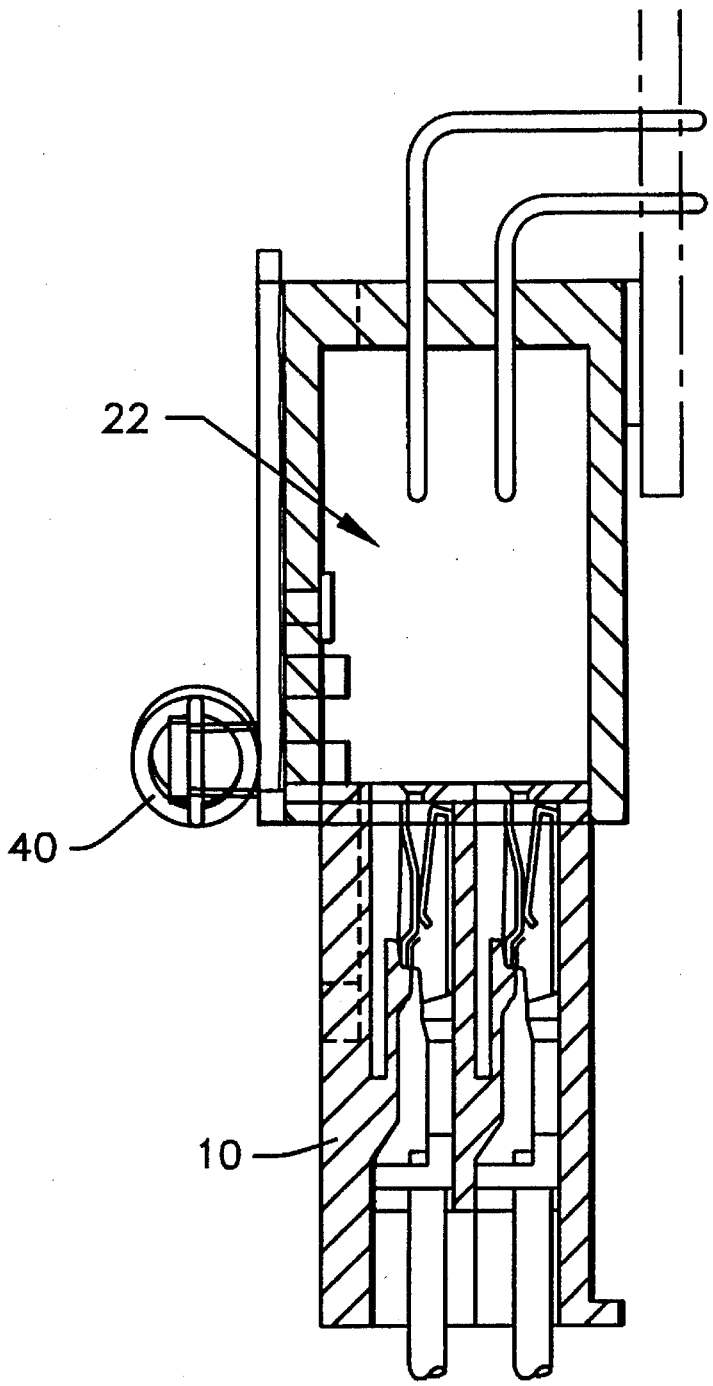
FIG. 15 is a side sectional view of the connectors in the state of FIG. 14.
Figure 16:
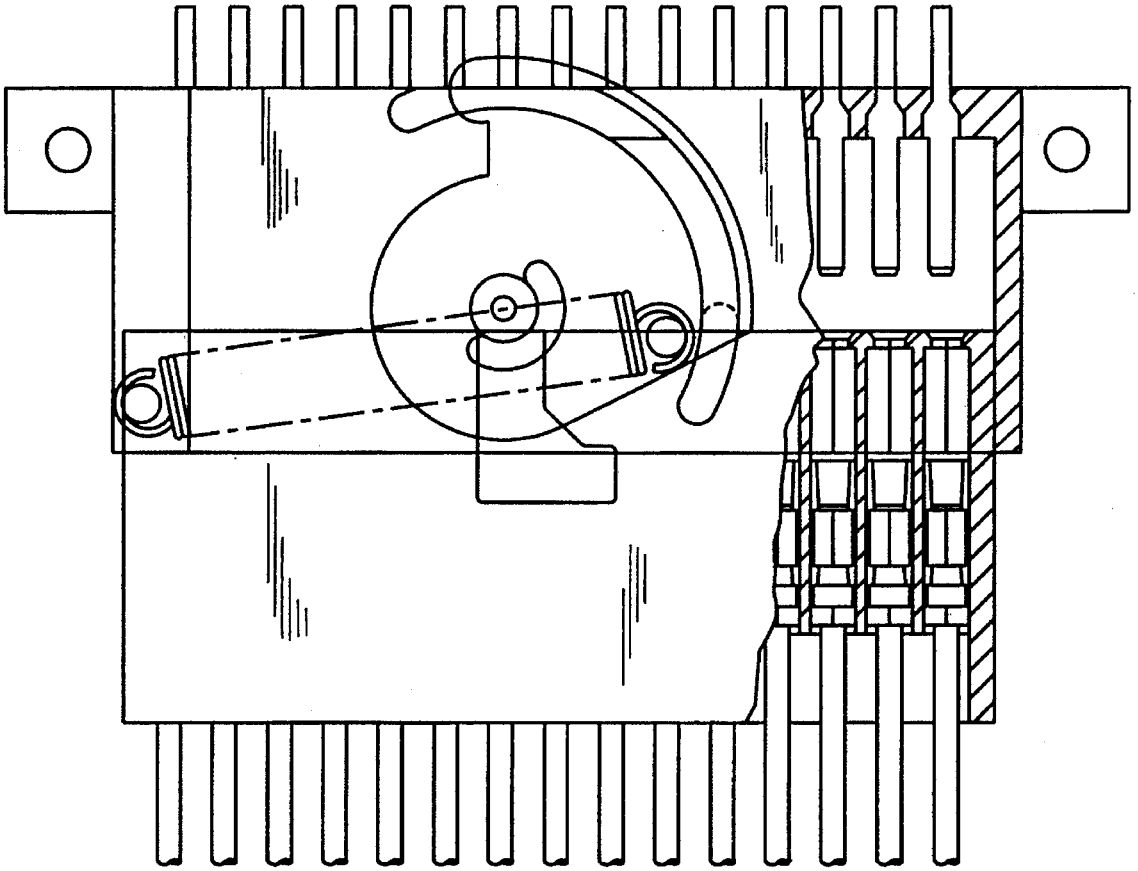
FIG. 16 is a partially cutaway view showing a coupling step of the connectors according to the second embodiment.

FIGS. 14 and 15 show the first coupling step of the two housings. In this step, the engaging pin of the pivotal piece is merely engaged with the latch groove of the male housing, and the pivotal piece is not pivoted yet.

Figure 17:
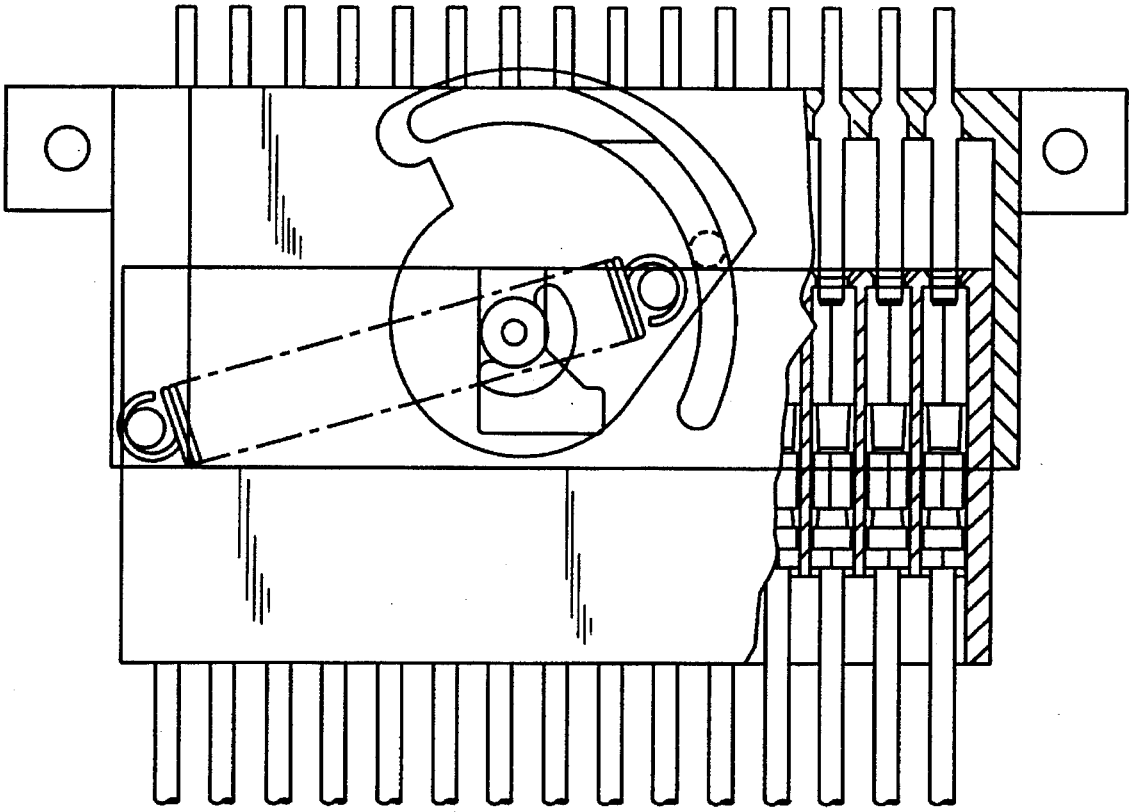
FIG. 17 is a partially cutaway view showing a coupling step of the connectors according to the second embodiment.
Figure 18:
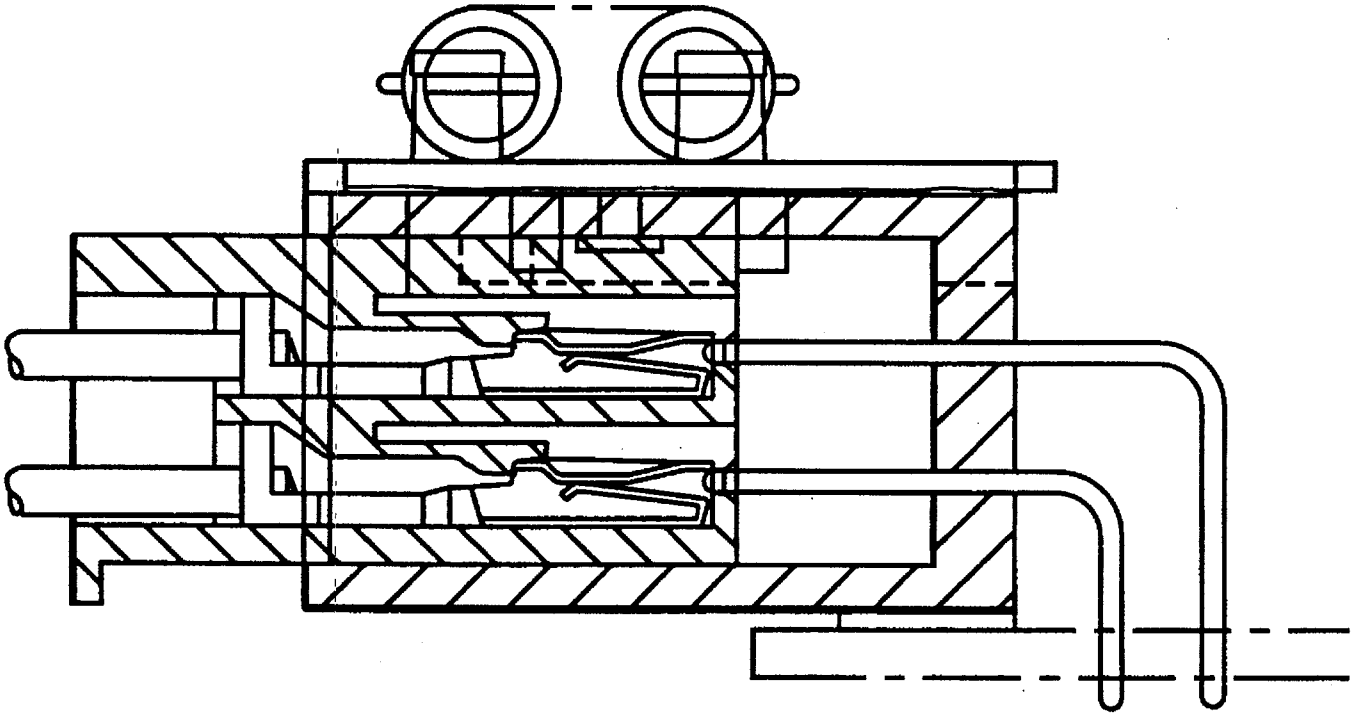
FIG. 18 is a side sectional view of the connectors in the state of FIG. 17.

The male housing is inserted in the female housing. At this time, since the spring 40 extends in accordance with the pivotal movement of the pivotal piece, the pivotal piece is pivoted against the force applied by the spring. Hence, the state shown FIGS. 17 and 18 is obtained through the state shown in FIG. 16. In this state, the spring and the rotating shaft of the pivotal piece are aligned on the same line (predetermined intermediate coupling state). Starting from this state as a boundary, the spring contracts, and the pivotal piece receives a force from the spring to pivot counterclockwise. Accordingly, in states from that of FIG. 19, the pivotal piece is pivoted counterclockwise without applying an external force to the housing. Note that the state shown in FIGS. 17 and 18 corresponds also to a time point when the female and male contacts contact each other to start connection.

Figure 19:
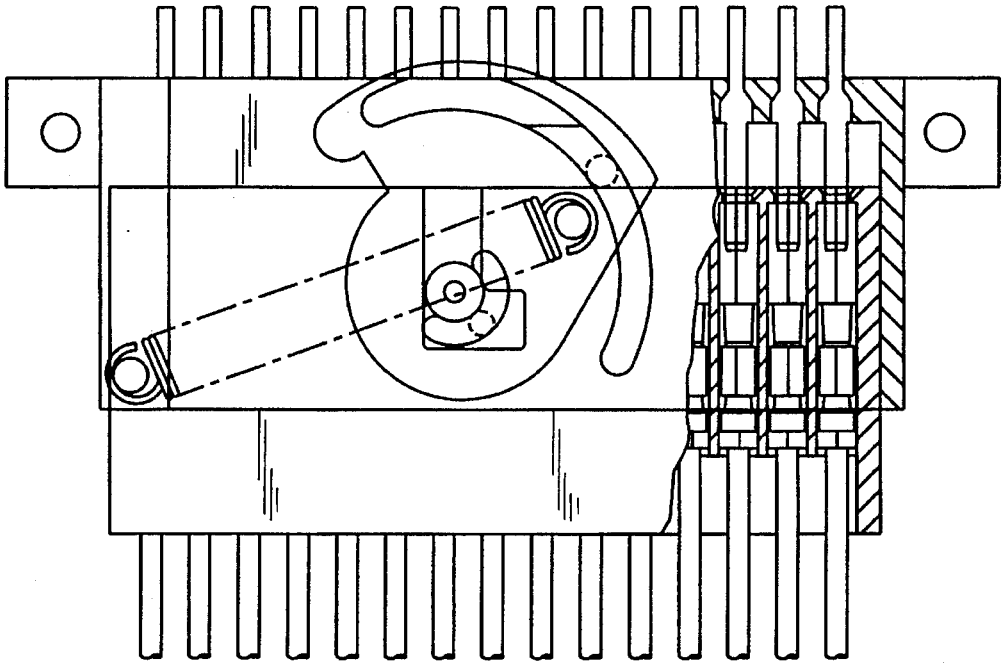
FIG. 19 is a partially cutaway view showing a coupling state of the connectors according to the second embodiment.
Figure 20:
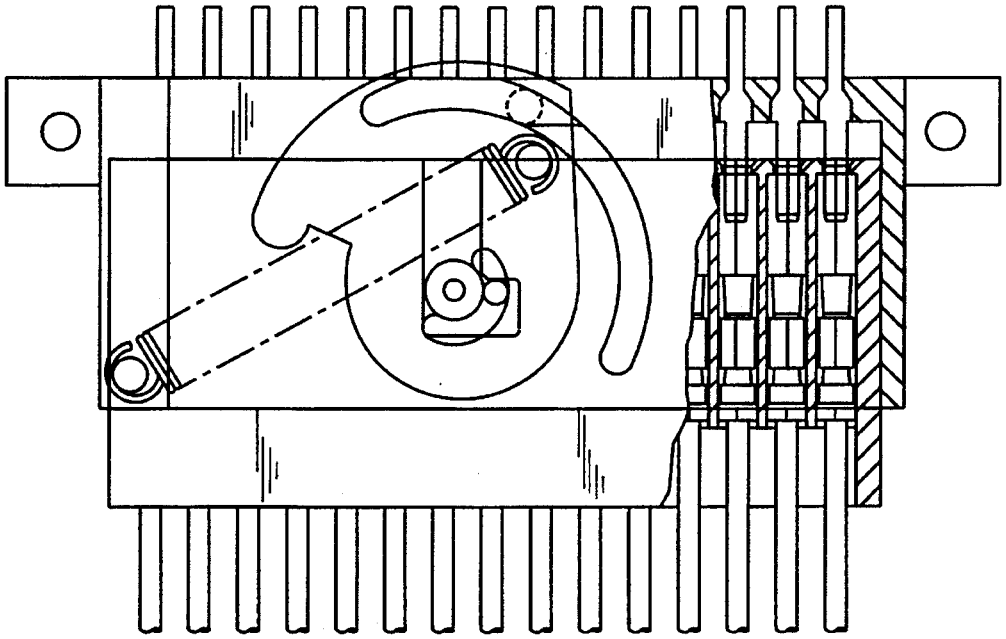
FIG. 20 is a partially cutaway view showing a coupling state of the connectors according to the second embodiment.

When the pivotal piece is pivoted to reach the state shown in FIG. 20 through the state shown in FIG. 19, the engaging pin is engaged with the bent portion of the latch groove, thereby connecting the female and male contacts with each other and latching the two housings.

Figure 21:
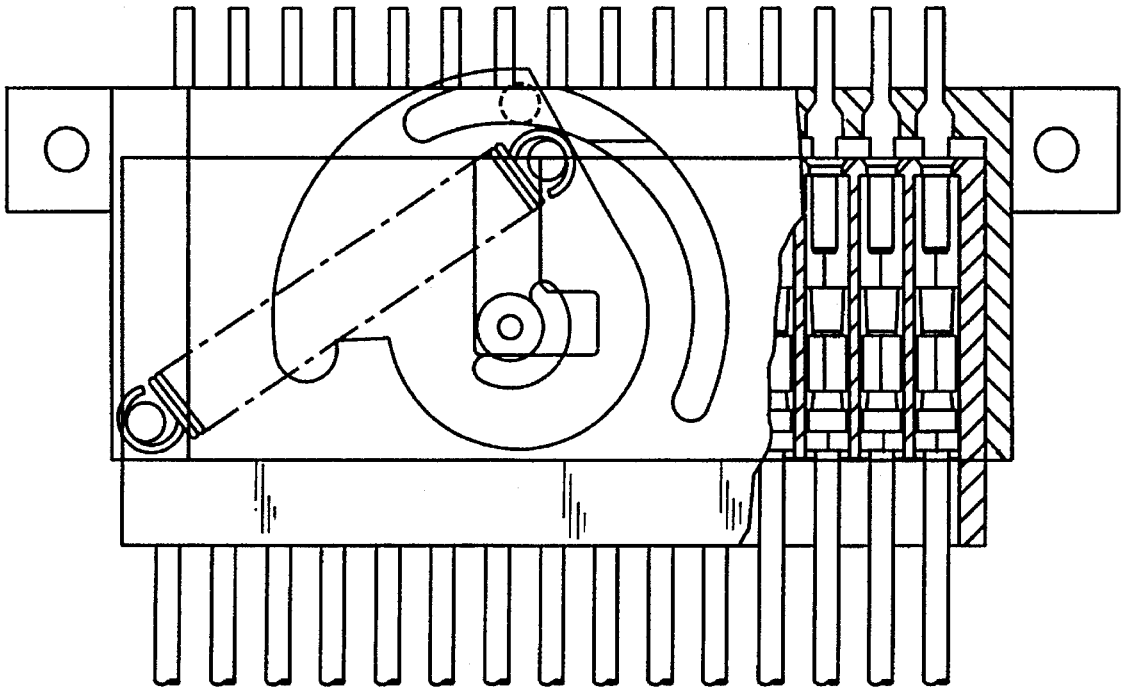
FIG. 21 is a partially cutaway view showing a coupling state of the connectors according to the second embodiment.
Figure 22:
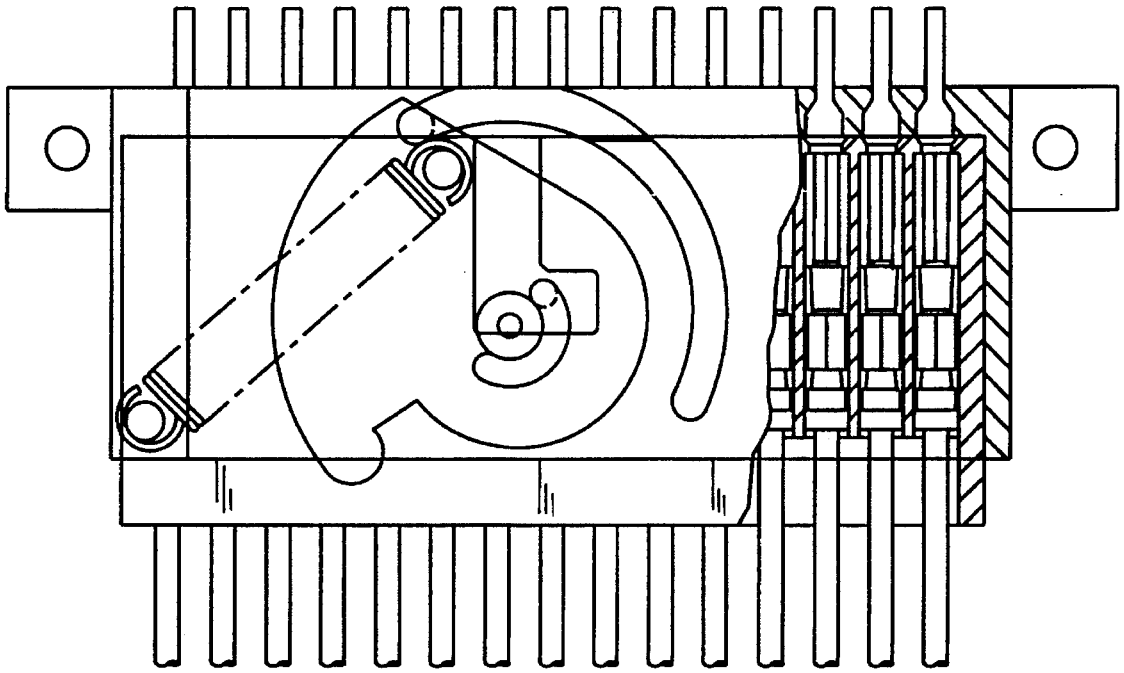
FIG. 22 is a partially cutaway view showing a coupling state of the connectors according to the second embodiment.
Figure 23:
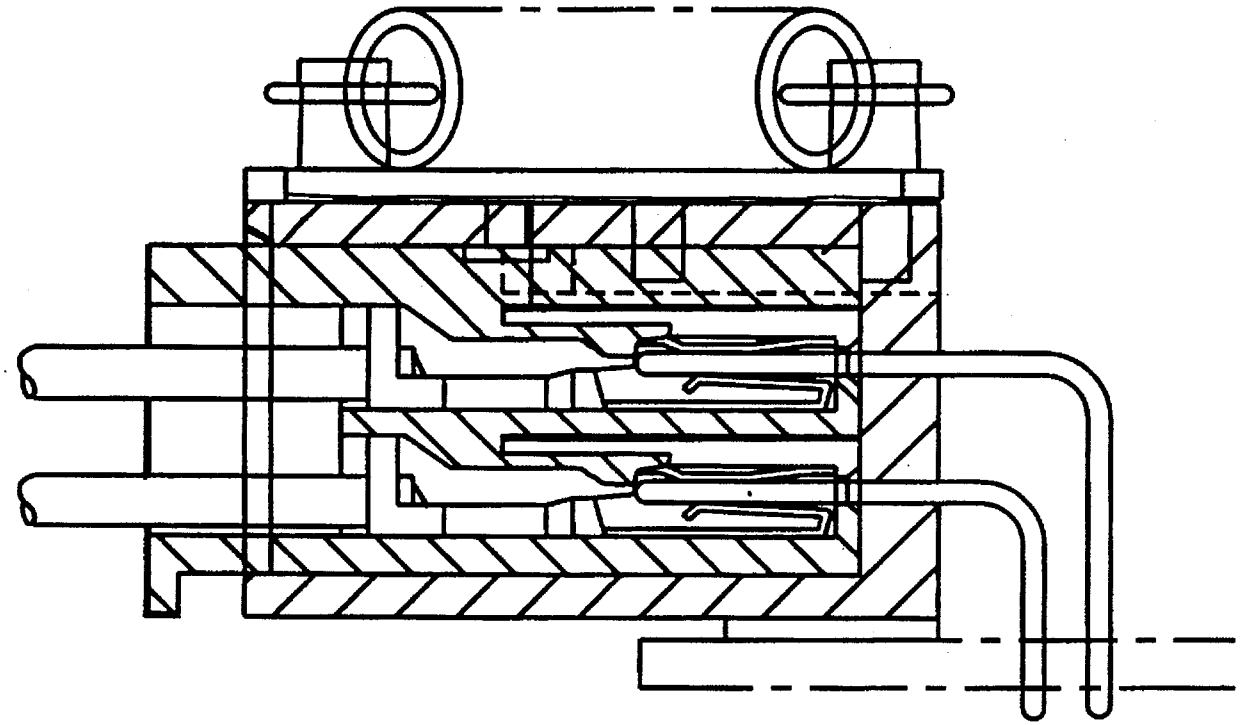
FIG. 23 is a side sectional view of the connectors in the state of FIG. 22.
Figure 24:
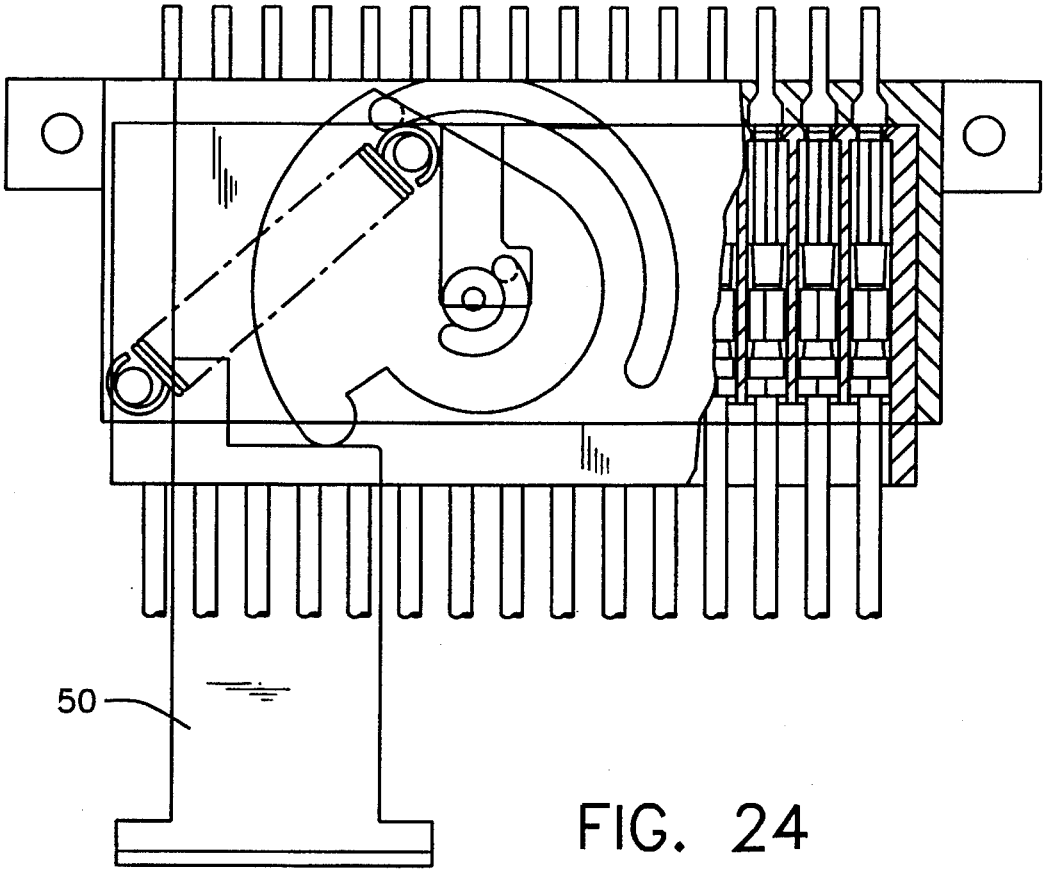
FIG. 24 is a partially cutaway view showing a step of separating the coupled connectors according to the second embodiment.
Figure 25:
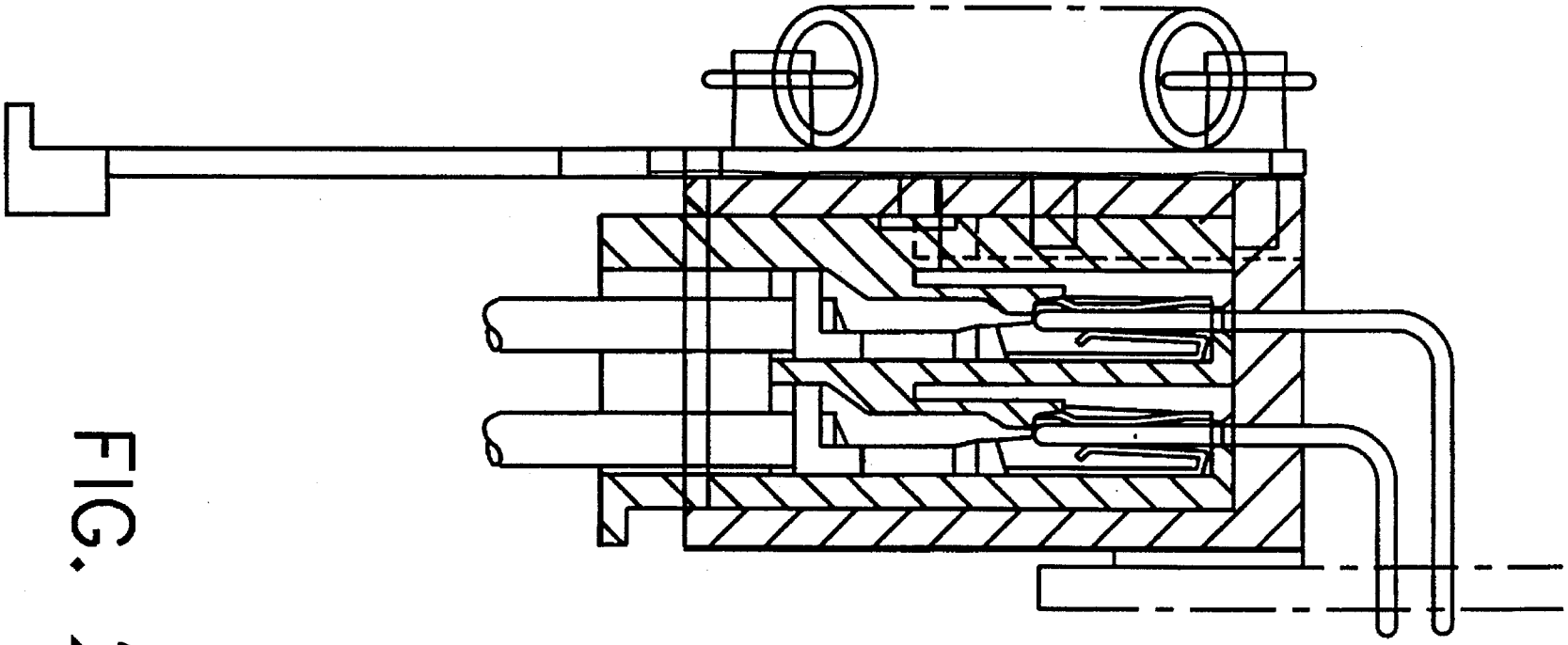
FIG. 25 is a side sectional view of the connectors in the state of FIG. 24.
Figure 26:
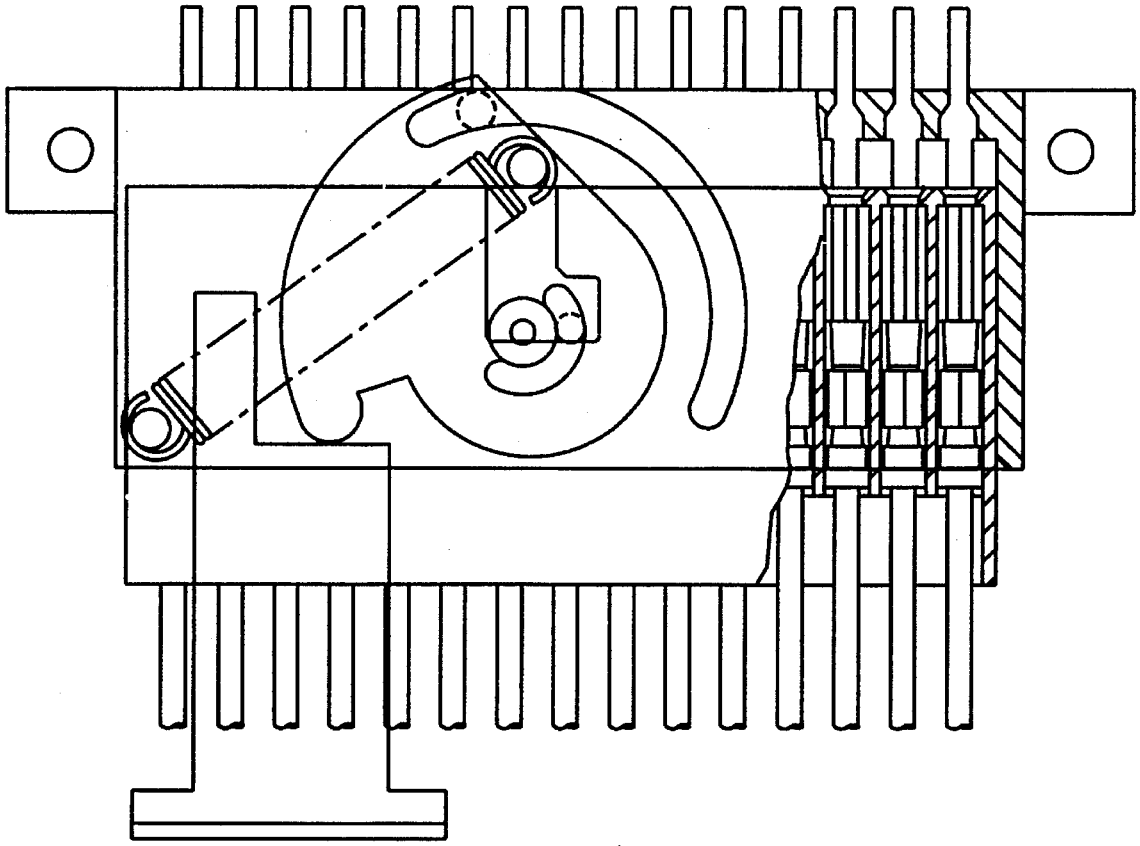
FIG. 26 is a partially cutaway view showing a step of separating the coupled connectors according to the second embodiment.
Figure 27:
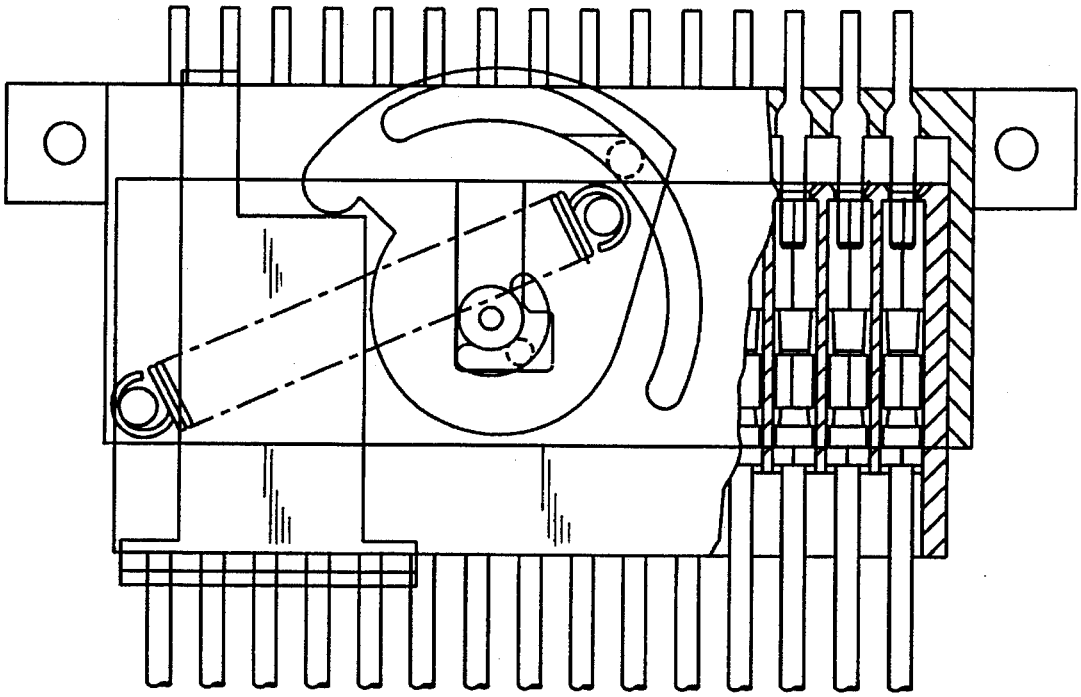
FIG. 27 is a partially cutaway view showing a step of separating the coupled connectors according to the second embodiment.
Figure 28:
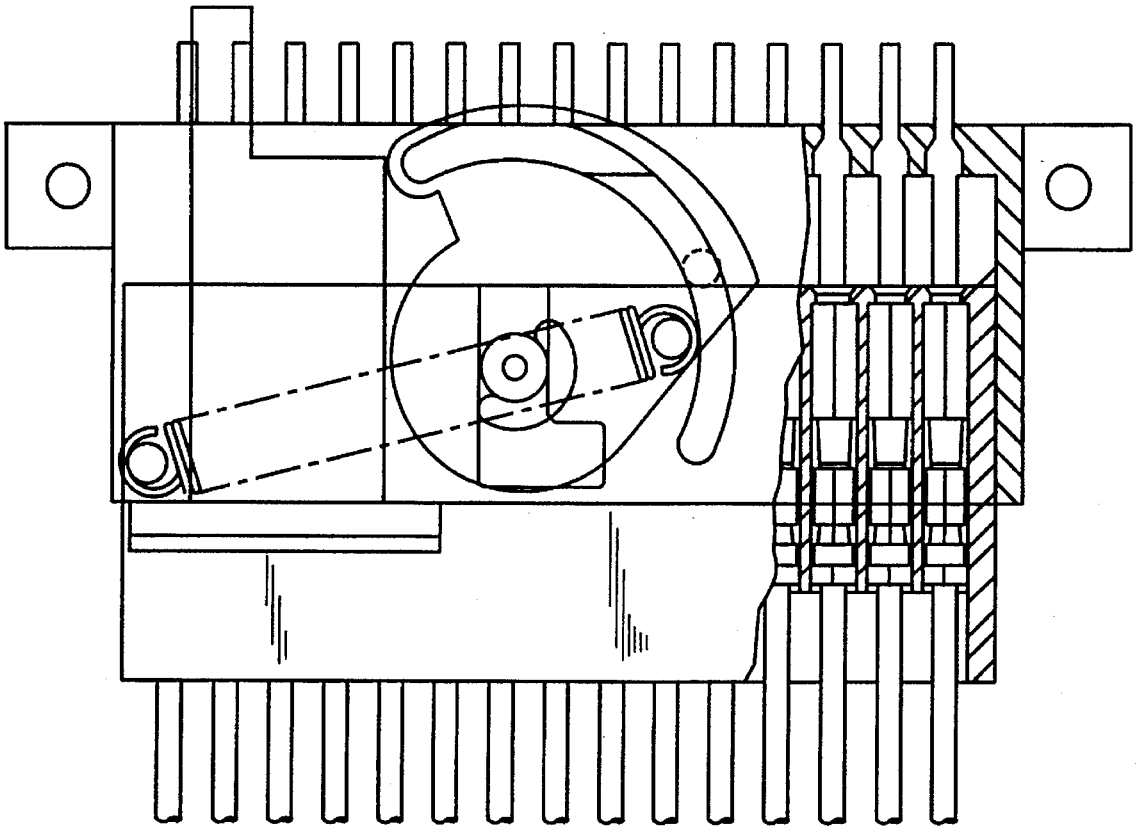
FIG. 28 is a partially cutaway view showing a step of separating the coupled connectors according to the second embodiment.
Figure 29:
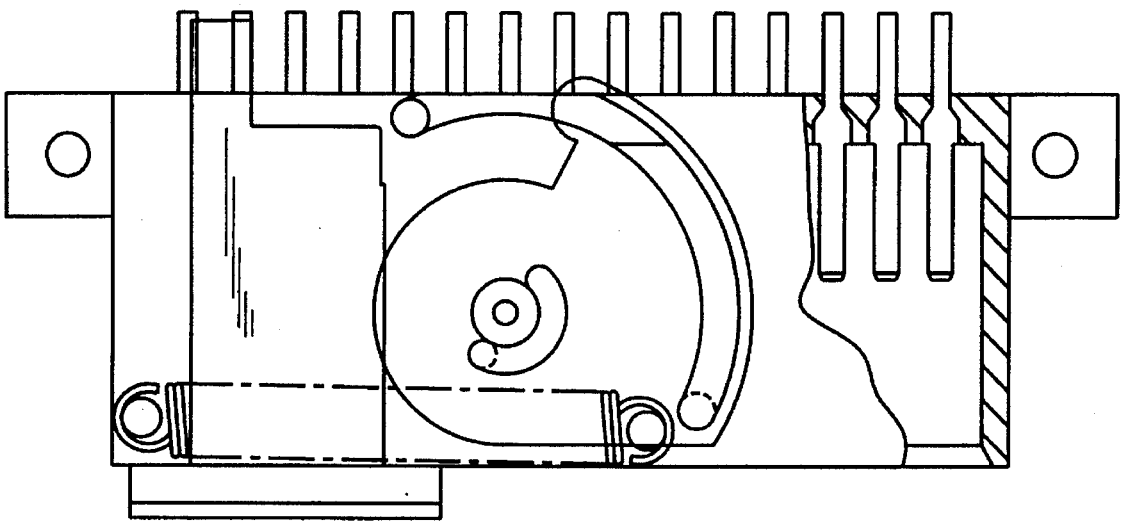
FIG. 29 is a partially cutaway view showing a step of separating the coupled connectors according to the second embodiment.

In the state of FIGS. 22 and 23, connection of the female and male contacts and coupling of the two housings are completed through the state shown in FIG. 21.

When compared to the first embodiment, in the second embodiment, the spring is parallel to the longitudinal direction of the connector, as is apparent from comparison of, e.g., FIGS. 3 and 12 showing the states of the female housing before coupling. In order to set the pivotal piece to a state similar to that of FIG. 3, the pivotal piece is pivoted by an amount required accordingly. For this purpose, in the second embodiment, the guide pin is provided to the pivotal piece and engaged with the guide groove of the housing. More specifically, when the male housing is inserted in the female housing, the male housing is abutted first against the guide pin in the hollow portion. Thus, an external force is applied against the force of the spring, so that the guide pin is slid in the guide groove, thereby pivoting the pivotal piece. The necessity of applying an external force in the initial state of coupling signifies that the pivotal piece will not be moved accidentally. Therefore, the second embodiment is more stable than the first embodiment.

If the pivotal piece is located at a position corresponding to the coupling state (set state) of the two housings despite that the two housings are separated from each other (in their reset state) (if the pivotal piece is erroneously pivoted to the state shown in FIG. 10 despite that the two housings are in the reset state), in this embodiment, the engaging pin and the latch groove have a non-engaging positional relationship. This prohibits the two connectors from being coupled to each other when the pivotal piece is erroneously pivoted before the two connectors are coupled, so that the connector is prevented from being erroneously inserted.

FIGS. 24 through 29 show steps of engaging an externally operable operational member with a projection 33 provided on part of the pivotal piece, and pivoting the pivotal piece in an opposite direction to that required for fitting the two housings, so that the two connectors coupled to each other are separated. At this time, the guide pin slides in the guide groove of the housing, thereby pivoting the pivotal piece.

Figure 30:
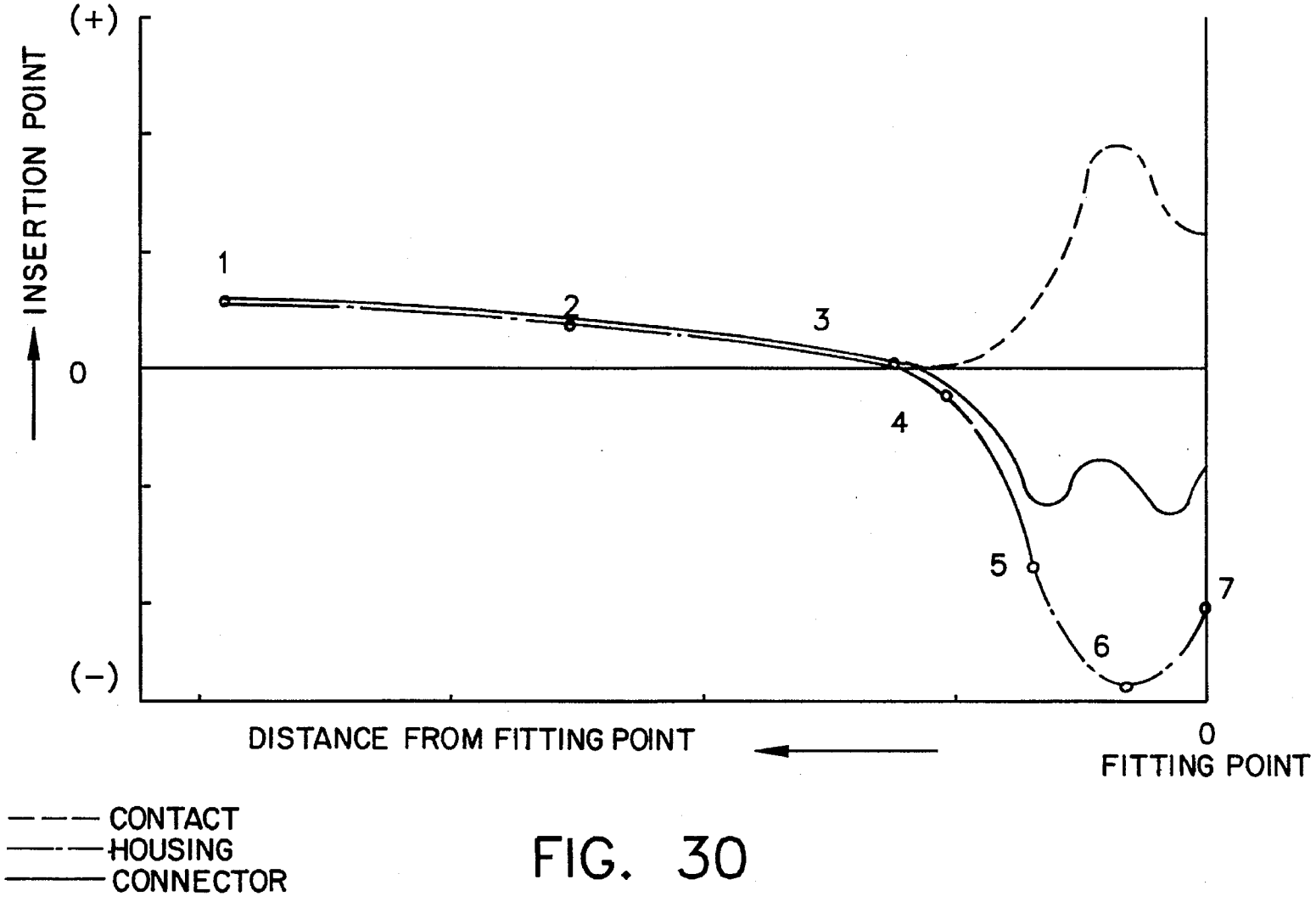
FIG. 30 is a graph showing the relationship between the distance of the connector according to the present invention from a reference position and an inserting force of the connector.

FIG. 30 shows the relationship among the distance of the connector from a fitting point (reference position of the connector when coupling is completed), an inserting force of the connector, and a force acting on the female connector (male housing) in the coupling step of the two connectors of the second embodiment. Referring to FIG. 30, points 1, 2, 3, 4, 5, 6, and 7 correspond to FIGS. 14 and 15, FIG. 16, FIGS. 17 and 18, FIG. 19, FIG. 20, FIG. 21, and FIGS. 22 and 23, respectively.

As is apparent from FIG. 30, the inserting force of the connector is zero at the point 3, and before the point 3, an external force for inserting the connector is required. After the point 3, the inserting force of the connector is negative. That is, insertion of the connector and connection of the contacts are completed with only the force of the spring without requiring an external force.

According to the connector of the present invention, when the two housings are coupled to each other, after the two housings reach a predetermined intermediate coupling state, the pivotal piece is pivoted by the operation of the spring, thereby completing coupling of the two housings and reliably latching the two housings. Therefore, a so-called semi-filled state can be prevented.

It suffices if the coupling operation of the connector is performed only once in one direction, and a special jig is not needed, leading to excellent operability.

The contacts can be set not to contact each other until the two housings reach the predetermined intermediate coupling state (until the force drawing the housing acts). Thus, an inconvenience such that the contacts contact each other in the semi-fitted state can be eliminated.

Since the inserting force required for inserting one connector in the other can be obtained only by applying a force until the predetermined intermediate coupling state is reached, it can be a low inserting force (a force required for connecting the contacts with each other need not be externally applied).

Having described the preferred embodiments herein, it should be appreciated that variations may be made thereto without departing from the contemplated scope of the invention. The true scope of the invention is set forth in the claims appended hereto.

We claim:

1. A connector comprising first and second housings (10) and (20) coupled to each other, a pivotal piece (30) pivotally provided on one of said two housings, a spring (40) interposed between said one housing and said pivotal piece, and latch means (12) for locking said two housings that are coupled to each other, said latch means comprising an engaging pin (31) provided on said pivotal piece, and a latch groove (12) formed in the other housing, wherein when said two housing are coupled, said pivotal piece is pivoted by said spring, thereby completing coupling of said two housings.

2. A connector according to claim 1 wherein said pivotal piece is pivoted by an external force against a force of said spring before said first and second housings reach a predetermined intermediate coupling state, and after said two housings reach the predetermined intermediate coupling state, said pivotal piece being pivoted to complete mutual coupling of said two housings.

3. A connector according to claim 1 wherein said first housing (10) is a male housing and has a plurality of female contacts (11) of a predetermined type, and said second housing is a female housing and has a hollow portion (22) for storing said male housing and a plurality of contacts (21) of a predetermined type that contact contacts of said male housing in the hollow portion.

4. A connector according to claim 3, wherein said contacts of said two housings contact each other after said two housings pass the predetermined intermediate coupling state.

5. A connector according to claim 4, wherein said engaging pin (31) projects into the hollow portion through a window hole (23) formed in a wall surface defining the hollow portion, and said latch groove (12) is formed in said male housing.

6. A connector according to claim 5, characterized in that said pivotal piece (30) further has a guide pin (32) projecting into the hollow portion through a guide groove (24) formed in said wall surface defining the hollow portion, and said guide pin slides in said guide groove upon insertion of said male housing in the hollow portion, thereby pivoting said pivotal piece.

7. A connector according to claim 1, wherein said spring (40) expands in accordance with a pivotal movement of said pivotal piece before said two housings reach the predetermined intermediate coupling state, and contracts when said two housings pass the predetermined coupling state.

8. A connector according to claim 1, wherein said pivotal piece has release means that can be externally operated in order to release a locking state of said two housings.

9. A connector according to claim 8, characterized in that said release means is a projection (33) provided to part of said pivotal piece and is operated by an external operational member (50) to pivot said pivotal piece in a direction opposite to that required when said two housings are coupled with other.

10. A connector according to claim 1, wherein when said pivotal piece is at the position of a set state and said two housings are in a reset state, said latch means interferes with coupling of said two housings.

11. A connector according to claim 10, wherein when said pivotal piece is at the position of the set state and said two housings are in the reset state, said engaging pin (31) and said latch (12) will not engage with each other.

12. A connector according to claim 1 comprising an operational member (50), movable in a direction opposite to that required for fitting said two housings when said two housings are fitted with each other, for releasing a locked state of said latch means.

13. A connector according to claim 12, wherein said operational member (50) is engaged with a projection (33) provided on part of said pivotal piece.

14. A connector comprising first and second housings (10) and (20) coupled to each other, a pivotal piece (30) pivotally provided on one of said two housings, a spring (40) interposed between said one housing and said pivotal piece, and latch means (12) for locking said two housings that are coupled to each other, wherein said first housing (10) is a male housing and has a plurality of female contacts (11) of a predetermined type, and said second housing is a female housing and has a hollow portion (22) for storing said male housing and a plurality of contacts (21) of a predetermined type that engage contacts of said male housing in the hollow portion, wherein when said two housings are coupled, said pivotal piece is pivoted by said spring, thereby completing coupling of said two housing.

15. A connector according to claim 14, wherein said contacts of said two housings engage each other after said two housings pass the predetermined intermediate coupling state.

16. A connector according to claim 14, wherein said latch means comprises an engaging pin (31) provided on said pivotal piece, and wherein a latch groove (12) is formed in the other housing.

17. A connector to claim 16, wherein said engaging pin (31) projects into the hollow portion through a window hole (23) formed in a wall surface defining the hollow portion, and said latch groove (12) is formed in said male housing.

18. A connector according to claim 17, characterized in that said pivotal piece (30) further has a guide pin (32) projecting into the hollow portion through a guide groove (24) formed in said wall surface defining the hollow portion, and said guide pin slides in said guide groove upon insertion of said male housing in the hollow portion, thereby pivoting said pivotal piece.

* * * * *